US011125488B2

(12) United States Patent
Bostic, Jr. et al.

(10) Patent No.: US 11,125,488 B2
(45) Date of Patent: Sep. 21, 2021

(54) CONTROLLED DEFROST FOR REFRIGERATION SYSTEMS

(71) Applicant: Standex International Corporation, Salem, NH (US)

(72) Inventors: Teddy Glenn Bostic, Jr., Summerville, SC (US); Gregory Joseph Deutschmann, Mt. Pleasant, SC (US); Chang H. Luh, Summerville, SC (US); Laura Steiner, Mt. Pleasant, SC (US)

(73) Assignee: Standex International Corporation, Salem, NH (US)

( * ) Notice: Subject to any disclaimer, the term of this patent is extended or adjusted under 35 U.S.C. 154(b) by 240 days.

(21) Appl. No.: 16/190,823

(22) Filed: Nov. 14, 2018

(65) Prior Publication Data

US 2019/0145693 A1 May 16, 2019

Related U.S. Application Data

(60) Provisional application No. 62/586,560, filed on Nov. 15, 2017.

(51) Int. Cl.
*F25D 21/00* (2006.01)
*A61J 1/06* (2006.01)
(Continued)

(52) U.S. Cl.
CPC ..... *F25D 21/006* (2013.01); *A61J 1/065* (2013.01); *A61J 1/165* (2013.01); *F25D 11/006* (2013.01); *F25D 16/00* (2013.01); *F25D 21/002* (2013.01); *F25D 29/006* (2013.01); *A61J 2200/72* (2013.01); *F25D 2303/0821* (2013.01)

(58) Field of Classification Search
CPC ..... F25D 21/006; F25D 16/00; F25D 11/006; F25D 2303/0821
See application file for complete search history.

(56) References Cited

U.S. PATENT DOCUMENTS 4,936,377 A * 6/1990 DeVogel ..... F25D 3/00 165/47
5,765,389 A * 6/1998 Salyer ..... F24F 5/0017 62/434

(Continued)

OTHER PUBLICATIONS

Centers for Disease Control and Prevention, "Vaccine Storage and Handling", Apr. 2013, Epidemiology and Prevention of Vaccine-Preventable Diseases, 13th Edition, pp. 63-77 (Year: 2013).*

*Primary Examiner* — Elizabeth J Martin
*Assistant Examiner* — Nael N Babaa
(74) *Attorney, Agent, or Firm* — Saxton & Stump

(57) ABSTRACT

Defrosting refrigeration equipment meeting the strict requirements for storage of vaccines provided by the Center for Disease Control, California Vaccine for Children, American Academy of Pediatrics, Vaccines for Children (VFC) and the North Dakota Department of Health among others. Vaccine refrigeration storage must maintain consistent temperatures between −58 degrees Fahrenheit and 5 degrees Fahrenheit. The invention utilizes temperature variation moderating heat reservoirs consisting of high specific or latent heat capacity materials to significantly reduce the cycle temperature variation while maintaining the ability to successfully defrost the freezer.

13 Claims, 1 Drawing Sheet

(51) Int. Cl.

| | |
|---|---|
| ***A61J 1/16*** | (2006.01) |
| ***F25D 29/00*** | (2006.01) |
| ***F25D 16/00*** | (2006.01) |
| ***F25D 11/00*** | (2006.01) |

(56) References Cited

U.S. PATENT DOCUMENTS

| | | | | |
|---|---|---|---|---|
| 6,295,831 | B1 * | 10/2001 | Watson | A47G 19/127 220/592.16 |
| 2013/0048647 | A1 * | 2/2013 | Farrar | F25D 11/006 220/592.01 |
| 2016/0243000 | A1 * | 8/2016 | Gray | F25D 11/006 |

* cited by examiner

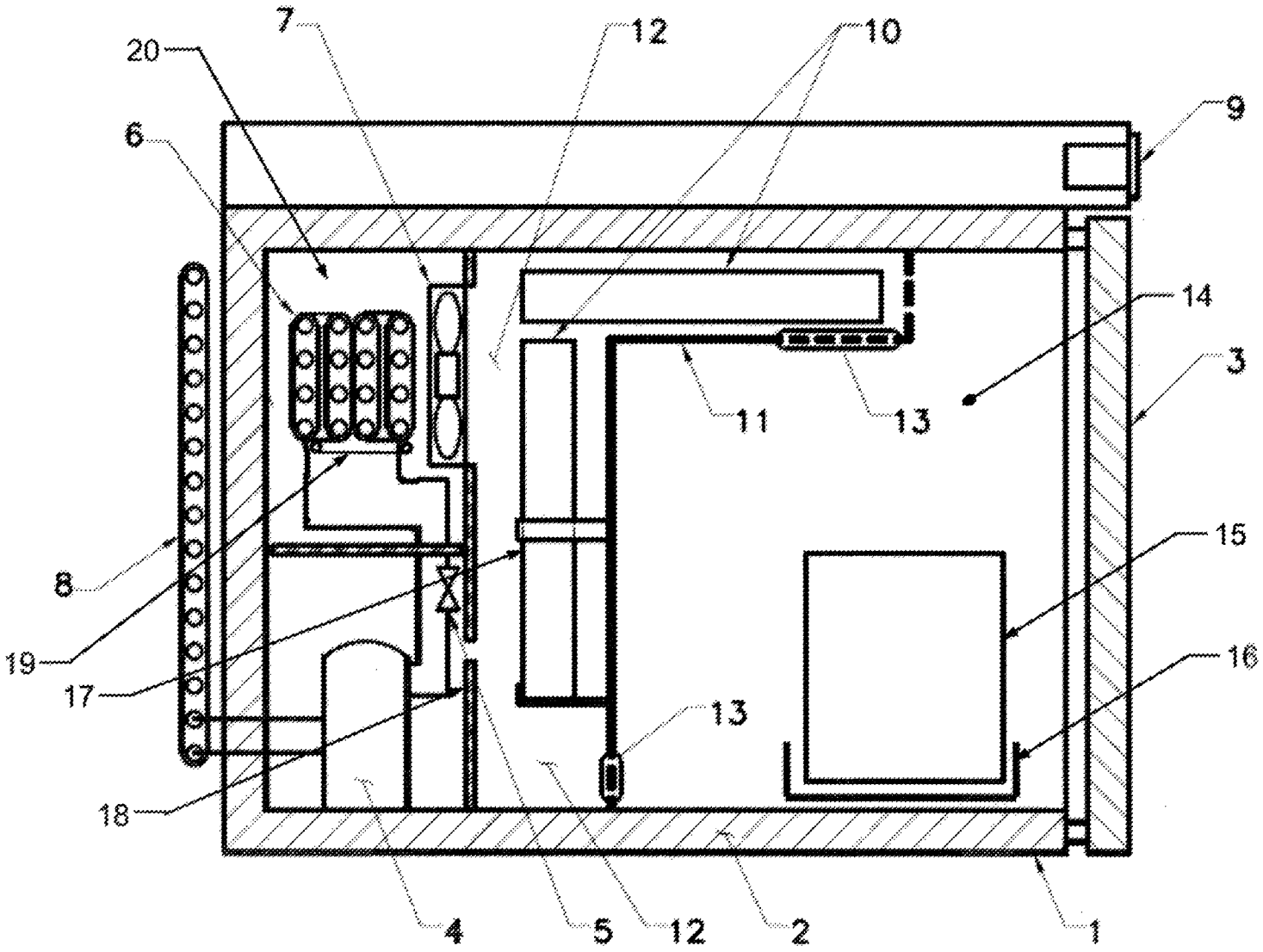
9
3
14
15
16
1
10
13
2
11
13
12
12
5
4
7
20
6
8
19
17
18

CONTROLLED DEFROST FOR REFRIGERATION SYSTEMS

This application claims benefit of U.S. Provisional Application Ser. No. 62/586,560, filed Nov. 15, 2017, pursuant to 35 USC § 119(e).

FIELD OF THE INVENTION

This invention relates to automatic defrost technology for refrigeration equipment, in particular, defrosting refrigeration equipment meeting the strict requirements for storage of vaccines provided by the Center for Disease Control, California Vaccine for Children, American Academy of Pediatrics, Vaccines for Children (VFC) and North Dakota Department of Health among others.

BACKGROUND OF THE INVENTION

In standard refrigeration equipment, the heat absorbing element of the cooling technology and other cooled surfaces will continually accumulate frost from atmospheric moisture rendering the system less efficient and inconvenient to maintain. A variety of automated defrost technologies are employed to eliminate frost buildup but these generally require heating the surfaces for a brief period thus raising the air and product temperature within the freezer. For some devices, this temperature variation exceeds the acceptable limits required to maintain product viability.

In the area of scientific refrigeration, there exists an operational challenge that limits the usage of freezers that utilize industry standard defrost technologies. Standard defrost technologies heat the interior of the freezer compartment temporarily to the point that the frost layer evaporates or drains away. For some products, such as vaccines, this temperature variation exceeds the acceptable limits required to maintain product viability. For example, the Centers for Disease Control (CDC) recommend that if a manual defrost freezer is used then another freezer storage unit that maintains the appropriate temperature must be available during the defrost period. Also, frost-free or automatic defrost cycles are preferred. Vaccine refrigeration storage must maintain consistent temperatures between −58 degrees Fahrenheit and 5 degrees Fahrenheit. (Between −50 degrees Centigrade and −15 Degrees Centigrade). The American Academy of Pediatrics recommends storing vaccines not warmer than minus 15 degrees Celsius plus or minus five degrees Celsius, even during defrost cycles.

There is not found in the prior art a method for controlling the temperature variations in a freezer during the defrost cycle that can be utilized in many standard freezer systems consisting of simple or elaborate variations of refrigerant evaporation, thermo-electric, controlled gas expansion or other cooling technologies and meets the temperature requirements for special storage situations such as vaccines.

The disclosed method utilizes temperature variation moderating heat reservoirs consisting of high specific or latent heat capacity materials to significantly reduce the cycle temperature variation while maintaining the ability to successfully defrost the freezer. This method also utilizes a secondary chamber and plenum outside of the evaporator chamber to regulate airflow, contain the heat reservoirs and thermally isolate the product chamber. An additional benefit is also realized in the event of a disruption or reduction in the cooling capacity (power outage, compressor failure, etc.) of the heat absorbing element of the cooling technology extending the amount of time the reduction can be tolerated without affecting the quality of the product contained within the freezer.

SUMMARY OF THE INVENTION

It is an aspect of the invention to provide a refrigeration defrost system that is suitable for use in low temperature units suitable for storage of vaccines.

Another aspect of the invention is to provide a refrigeration defrost system that never results in a temperature rise of more than 11 degrees Centigrade even during defrost mode.

Still another aspect of the invention is to provide a refrigeration defrost system that can be adapted for any low temperature freezer.

Another aspect of the invention is to provide a refrigeration defrost system wherein the temperature variance moderation chamber can be constructed of either plastic or metal.

Still another aspect of the invention is to provide a defrost system that in the event of a disruption or reduction in the cooling capacity (power outage, compressor failure, etc.) of the heat absorbing element of the cooling technology wherein extending the amount of time the reduction in cooling capacity can be tolerated.

BRIEF DESCRIPTION OF THE DRAWINGS

FIG. 1 is an illustration of the preferred embodiment in accordance with the invention.

DETAILED DESCRIPTION OF THE INVENTION

The invention generally relates to the field of hybrid refrigeration and the ability to precisely control temperature, moderate temperature due to heating processes, extend passive temperature control timeframes, better assure product quality and reduce manual maintenance requirements. Refrigeration systems typically rely on intermittent heating cycles to eliminate the accumulation of frost. Typical defrosting technologies raise the temperature of the air within the freezer to levels unacceptable for certain applications due to this heating cycle.

Referring now to FIG. 1, the preferred embodiment of the invention is illustrated. The refrigeration system is standard with the exception of the defrost invention. The system features typical condenser 8 which has approximately 180" to 240" linear inches of metal tubing approximately 0.16" in diameter. The system also has a hermetical sealed compressor 4. Compressor 4 is preferably Model TT1112NY as made by Jiaxipera. Although similar compressors such as made by Copland Corporation or Tecumseh Corporation would also be suitable.

Evaporator 6 is approximately 80 to 160 linear inches of metal tubing approximately 0.25 inches in diameter with fins for heat transfer and integrated evaporator heating element 19 and expansion device 5 such as an orifice or small diameter tube residing within the evaporator chamber 20. Also included in the system is an axial airflow induction fan 7 approximately 3.50 inches in diameter, mounted on the chamber dividing wall 18 and digital controller 9 as manufactured by Dixell (part number XR70 or XR75) that measures chamber temperature and regulates refrigeration system operation.

The evaporator heating element 19 is an electrically resistive component that becomes hot when subject to electric current. The insulated freezer housing 1 is constructed of an inner and outer shell containing an insulating material 2. Access to the interior of the system is provided by a similarly insulated door 3.

Evaporator 6 is separated from the product storage chamber 14 by the temperature variance moderation chamber 12. Chilled air is circulated by the axial airflow induction fan 7.

The temperature variance moderation chamber 12 (the newly defined volume) can be constructed from plastic or metal.

Temperature variance moderation chamber 12 consists of a dividing plenum wall 11, with a plurality of integrated retaining clips 17, a plurality of vents 13 located to induce beneficial convection and sized to optimize the thermal transfer to the indicated thermal reservoirs 10. The two to four thermal reservoirs 10 are nominally 8.5 inch×7.5 inch× 0.88 inch.

Temperature variance moderation chamber 12 is adjacent to the product storage chamber 14.

Stored frozen vaccine 15 is contained in product storage chamber 14. The stored frozen vaccine 15 can hold many individual bottles containing a single dose of vaccine. The stored frozen vaccine 15 can be stored loose or contained in trays or baskets 16.

Proportionalities and relationships between the various elements in this embodiment are critical to successful operation and are identified as follows:

Product storage chamber 14 volume relative to the temperature variance moderation chamber 12 volume ratio is nominally 4.6 having a tolerance zone of 3 to 5.5.

The latent heat of reservoirs 10 ratio to product storage chamber 14 volume is nominally 260 ((J/g)/in$^3$) having a tolerance zone of 100 to 600 ((J/g)/in$^3$).

Product storage chamber 14 area relative to dividing plenum wall 11 inward surface area ratio is nominally 3.1 having a tolerance zone of 1 to 10.

Dividing plenum wall 11 inward surface relative to the total thermal reservoir 10 surface area ratio is nominally 1.8 having a tolerance zone of 0.5 to 4.0.

Product storage chamber 14 is maintained at a minimum delta of 0° C. higher temperature to a maximum delta of −10° C. higher temperature than the freezing point of the thermal reservoir 10.

Product storage chamber 14 is maintained at a minimum delta of 0° C. lower temperature to a maximum delta of −20° C. lower temperature than the recommended storage temperature of the stored frozen vaccine 15.

Thermal reservoirs 10 freezing point temperature is a minimum delta of 0° C. lower temperature to a maximum delta of −20° C. lower temperature than the recommended storage temperature of the stored frozen vaccine 15.

At storage, the refrigeration systems draws down the temperature of the product storage chamber 14 using a typical vapor compression cycle utilizing R600, R290 or a mixture of the two as a refrigerant.

As temperature variance moderation chamber 12 and product storage chamber 14 temperature is reduced to the minimum operating range (typically −25° C.), thermal reservoirs 10 loose heat through this process.

When digital controller 9 initiates an automatic defrost cycle and the refrigeration system is inactive thermal reservoirs 10 absorb heat via free convection in product storage chamber 14 and maintain the temperature of product storage chamber 14 below the critical vaccine storage temperature throughout the defrost cycle.

Critically, as a process parameter, axial airflow induction fan 7 will not engage until the air temperature around evaporator 6 and in the evaporator chamber 20 has dropped to between −5° C. and −20° C. after a defrost cycle.

Critically, thermal reservoirs 10 and plenum dividing wall 11 create a thermal barrier between evaporator 20 and product storage chamber 14 so the temperature increase induced by evaporator heating element 19 during a defrost cycle does not adversely affect the stored frozen vaccine 15.

Although the present invention has been described with reference to certain preferred embodiments thereof, other versions are readily apparent to those of ordinary skill in the preferred embodiments contained herein.

What is claimed is:

1. A refrigeration system having an automatic defrost cycle, said refrigeration system comprising:

a compressor, condenser, evaporator and fan arranged and disposed to provide refrigeration to the refrigeration system with the automatic defrost cycle;

a digital controller that regulates the refrigeration system and also initiates the automatic defrost cycle;

a product storage chamber for storing a plurality of individual bottles of vaccine at a predetermined temperature variance even during the automatic defrost cycle to maintain vaccine viability;

a temperature variance moderation chamber adjacent to said vaccine storage compartment; wherein said temperature variance moderation chamber further comprises:

a plurality of thermal reservoirs made of materials having a latent heat capacity to reduce a cycle temperature variation while maintaining the ability to defrost the refrigeration system during the automatic defrost cycle;

a dividing plenum wall dividing said temperature variance moderation chamber from said product storage chamber; wherein said plenum wall has a plurality of integrated retaining clips for holding said plurality of thermal reservoirs to said plenum wall and wherein said plenum wall having a plurality of vents to provide convection between said plurality of thermal reservoirs and said product storage chamber wherein said automatic defrost cycle maintains the temperature variance of the product storage chamber so that the temperature of the product storage chamber does not exceed a consistent temperature requirement;

wherein the evaporator is disposed in an evaporator chamber that is separated from the product storage chamber by the temperature variation moderation chamber.

2. The refrigeration system of claim 1 wherein said product storage chamber has a volume ratio relative to the volume of said temperature variance moderation chamber ranging from 3 to 5.5.

3. The refrigeration system of claim 2 wherein said product storage chamber has a volume ratio relative to the volume of said temperature variance moderation chamber of 4.6.

4. The refrigeration system of claim 1 wherein said plurality of thermal reservoirs has a latent heat relative to the volume of said product storage chamber ranging from 100 to 600 ((J/g)/in$^3$).

5. The refrigeration system of claim 4 wherein said plurality of thermal reservoirs having a latent heat relative to the volume of said product storage chamber of 260 ((J/g)/in$^3$).

6. The refrigeration system of claim 1 wherein said product storage chamber has a product storage chamber area ratio of a total inwardly facing wall surface area of the product storage chamber to a total inwardly facing wall surface area of said dividing plenum wall ranging from 1 to 10.

7. The refrigeration system of claim 6 wherein said product storage chamber area ratio is about 3.1.

8. The refrigeration system of claim 1 wherein the temperature variation moderation chamber has a temperature variation moderation chamber area ratio of a total inwardly facing wall surface area of said dividing plenum wall to a total outer surface area of said plurality of thermal reservoirs ranging from 0.5 to 4.0.

9. The refrigeration system of claim 8 wherein the temperature variation moderation chamber area ratio is about 1.8.

10. The refrigeration system of claim 1 wherein said product storage chamber is maintained at temperature ranging from a minimum delta of 0° C. higher temperature to a maximum delta of −10° C. higher temperature than the freezing point of at least one of said plurality of thermal reservoirs.

11. The refrigeration system of claim 1 wherein said product storage chamber is maintained at a temperature ranging from a minimum delta of 0° C. lower temperature to a maximum delta of −20° C. lower temperature according to the at least one consistent temperature requirement for the plurality of individual bottles of vaccine in said product storage chamber.

12. The refrigeration system of claim 1 wherein the freezing point temperature of said plurality of thermal reservoirs is maintained at a temperature ranging from a minimum delta of 0° C. lower temperature to a maximum delta of −20° C. lower temperature than the recommended storage temperature of the plurality of individual bottles of vaccine in said product storage chamber.

13. The refrigeration system of claim 1 wherein, during the storage of vaccines in said product storage chamber, said refrigeration system draws down the temperature of said product storage chamber using a vapor compression cycle utilizing a refrigerant selected from the group consisting of R600, R290, and a mixture of the two.

* * * * *